US009777736B2

(12) United States Patent
Shih et al.

(10) Patent No.: US 9,777,736 B2
(45) Date of Patent: Oct. 3, 2017

(54) BACKFLOW PREVENTION DEVICE AND A FAN HAVING THE SAME

(71) Applicant: Wistron Corporation, New Taipei (JP)

(72) Inventors: Wei-Ta Shih, New Taipei (TW); Shih-Huai Cho, New Taipei (JP)

(73) Assignee: Wistron Corporation, New Taipei (TW)

( * ) Notice: Subject to any disclaimer, the term of this patent is extended or adjusted under 35 U.S.C. 154(b) by 425 days.

(21) Appl. No.: 14/511,083

(22) Filed: Oct. 9, 2014

(65) Prior Publication Data

US 2015/0252813 A1 Sep. 10, 2015

(30) Foreign Application Priority Data

Mar. 7, 2014 (TW) ..... 103107882 A

(51) Int. Cl.
*F04D 25/14* (2006.01)
*F04D 19/00* (2006.01)

(52) U.S. Cl.
CPC ..... *F04D 25/14* (2013.01); *F04D 19/002* (2013.01)

(58) Field of Classification Search
CPC ..... F04D 19/002; F04D 25/14
See application file for complete search history.

(56) References Cited

U.S. PATENT DOCUMENTS 4,773,589 A * 9/1988 Boyd ..... F24B 1/18 126/502
8,007,228 B2 8/2011 Wang
8,072,756 B1 * 12/2011 Janes ..... H05K 7/20909 361/695
2011/0116909 A1 * 5/2011 Weisser ..... F04D 25/0613 415/126
2011/0259550 A1 * 10/2011 Komaba ..... F16K 1/222 165/96
2013/0278120 A1 * 10/2013 Elkins ..... H05K 5/0213 312/236

FOREIGN PATENT DOCUMENTS

TW 200704883 * 2/2007 ..... F04D 29/40
TW 201002946 * 1/2010 ..... F04D 29/40
TW 201323727 6/2013

OTHER PUBLICATIONS

Taiwanese Office Action, dated Aug. 4, 2015, Taiwanese Counterpart Application No. 103107882.
"Office Action of China Counterpart Application," with English translation thereof, dated May 3, 2017, p. 1-p. 8.

* cited by examiner

*Primary Examiner* — Woody Lee, Jr.
(74) *Attorney, Agent, or Firm* — Jianq Chyun IP Office

(57) ABSTRACT

A backflow prevention device includes a plurality of flaps that are connected pivotally to a casing of a fan. When a blade unit of the fan rotates to generate an airflow entering the casing via an airflow inlet and exiting the casing via an airflow outlet, the flaps are driven to pivot away from the blade unit to open positions, where the flaps serve as stator blades for the fan. When rotation of the blade unit is stopped, the flaps are driven by a reverse flow directed toward the airflow outlet and the blade unit to pivot toward the blade unit to closed positions, where the flaps close the airflow outlet to prevent air from entering the casing via the airflow outlet.

3 Claims, 8 Drawing Sheets

BACKFLOW PREVENTION DEVICE AND A FAN HAVING THE SAME

CROSS-REFERENCE TO RELATED APPLICATION

This application claims priority of Taiwanese Application No. 103107882, filed on Mar. 7, 2014, the disclosure of which is incorporated herein by reference.

BACKGROUND OF THE DISCLOSURE

1. Field of the Disclosure

The disclosure relates to a fan, more particularly to a fan having a backflow prevention device.

2. Description of the Related Art

A network server is demanded to provide services uninterruptedly, and is equipped with a fan assembly for heat dissipation. The fan assembly draws cool air from an upstream side for dissipating heat from electronic components of the server, and exhausts heated air toward a downstream side. Once a fan of the fan assembly breaks down, the heated air disposed at the downstream side of the fan assembly may be drawn toward the electronic components (i.e., a backflow occurs) since an air pressure at the downstream side is greater than that at the upstream side, so that a cooling capacity of the fan assembly may thereby be lowered.

Referring to FIGS. 1 and 2, a conventional fan of such a fan assembly (not shown) includes a fan body 91 and a backflow prevention device 92. The fan body 91 includes a casing 911 that has an airflow inlet 9A and an airflow outlet 9B opposite to the airflow inlet 9A, a blade unit 912 that is disposed rotatably in the casing 911 and that is adjacent to the airflow inlet 9A, and a plurality of stator blades 913 that are formed integrally in the casing 911 and that is adjacent to the airflow outlet 9B. The backflow prevention device 92 includes a mounting frame 921 that is disposed adjacent to the airflow outlet 9B, and a plurality of slats 922 that are connected pivotally to the mounting frame 921 and that are parallel to each other.

When the blade unit 912 rotates to generate an airflow that enters the casing 911 via the airflow inlet 9A and exits the casing 911 via the airflow outlet 9B, the stator blades 913 serves to concentrate and intensify the airflow, and the slats 922 are opened for passage of the airflow (see FIG. 1).

When the blade unit 912 is stopped, the slats 922 are driven by a backflow resulting from a pressure difference between opposite sides of the backflow prevention device 92 to close the airflow outlet 9B of the casing 911 (see FIG. 2) for preventing further backflows.

However, the slats 922 may diminish the airflow that is generated by the blade unit 912 and intensified by the stator blades 913. Moreover, the conventional fan has a considerable thickness.

SUMMARY OF THE DISCLOSURE

Therefore, one object of the present disclosure is to provide a backflow prevention device and that can overcome the aforesaid drawbacks associated with the prior arts.

Accordingly, a backflow prevention device of the present disclosure is adapted for use in a fan. The fan includes a casing that defines an airflow inlet and an airflow outlet, and a blade unit that is disposed rotatably in the casing. The backflow prevention device includes a plurality of angularly-arranged flaps that are adapted to be disposed adjacent to the airflow outlet. Each of the flaps has a pin segment and a wing segment. The pin segment is adapted to be connected pivotally to an outer surface of the casing, and has a first pin end adapted to be proximate to a rotating axis of the blade unit, and a second pin end opposite to the first pin end and adapted to be distal from the rotating axis. The wing segment extends from a portion of the pin segment between the first and second pin ends. When the blade unit is driven to rotate to generate an airflow that enters the casing via the airflow inlet and exits the casing via the airflow outlet, the flaps are driven by the airflow to pivot away from the blade unit to open positions, where each of the flaps forms an angle relative to the outer surface of the casing, and the flaps are adapted to serve as stator blades for the fan. When rotation of the blade unit is stopped, the flaps are driven by a reverse flow directed toward the airflow outlet and the blade unit to pivot toward the blade unit to closed positions, where the flaps close the airflow outlet to prevent air entering the casing via the airflow outlet.

Another object of the present disclosure is to provide a fan that has a backflow prevention device and that can overcome the aforesaid drawbacks associated with the prior arts.

Accordingly, a fan of the present disclosure includes a casing, a blade unit and a backflow prevention device. The casing defines an airflow inlet and an airflow outlet. The blade unit is disposed rotatably in the casing. The backflow prevention device includes a plurality of angularly-arranged flaps that are disposed adjacent to the airflow outlet. Each of the flaps has a pin segment and a wing segment. The pin segment is connected pivotally to an outer surface of the casing, and has a first pin end proximate to a rotating axis of the blade unit, and a second pin end opposite to the first pin end and distal from the rotating axis. The wing segment extends from a portion of the pin segment between the first and second pin ends. When the blade unit is driven to rotate to generate an airflow that enters the casing via the airflow inlet and exits the casing via the airflow outlet, the flaps are driven by the airflow to pivot away from the blade unit to open positions, where each of the flaps forms an angle relative to the outer surface of the casing, and the flaps serve as stator blades for the fan. When rotation of the blade unit is stopped, the flaps are driven by a reverse flow directed toward the airflow outlet and the blade unit to pivot toward the blade unit to closed positions, where the flaps close the airflow outlet to prevent air entering the casing via the airflow outlet.

BRIEF DESCRIPTION OF THE DRAWINGS

Other features and advantages of the present disclosure will become apparent in the following detailed description of the embodiments with reference to the accompanying drawings, of which.

DETAILED DESCRIPTION OF THE EMBODIMENTS

Figure 1:
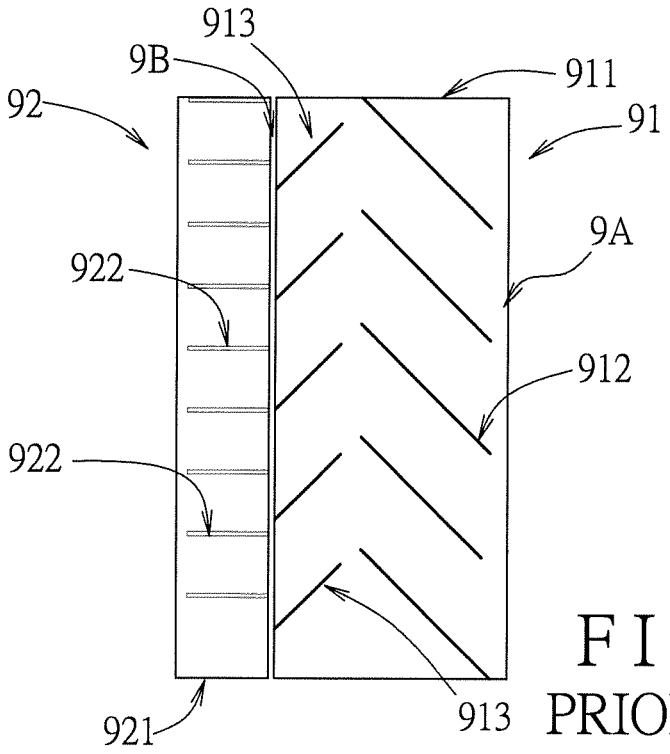
FIG. 1 PRIOR ART
FIG. 1 is a schematic side view of a conventional fan, illustrating that slats of a backflow prevention device of the conventional fan are opened.
Figure 2:
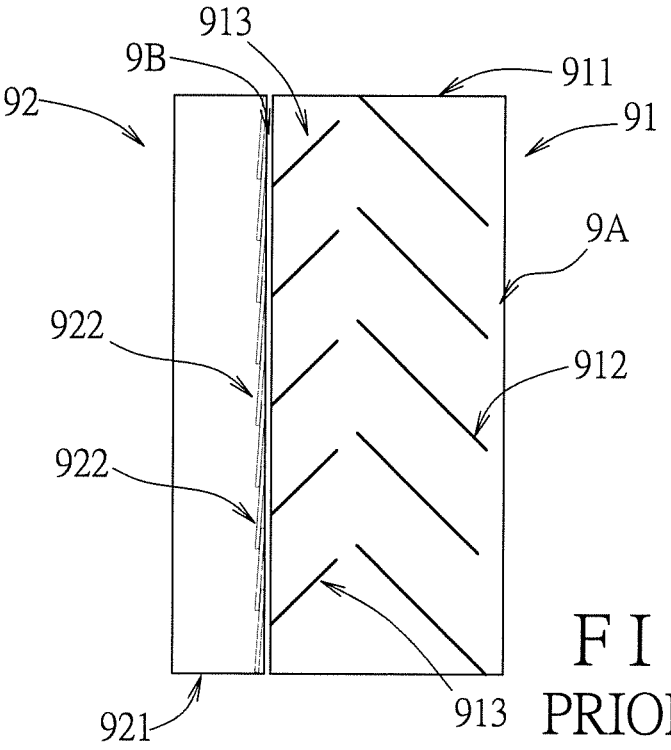
FIG. 2 PRIOR ART
FIG. 2 is another schematic side view of the conventional fan, illustrating that the slats are closed.
Figure 3:
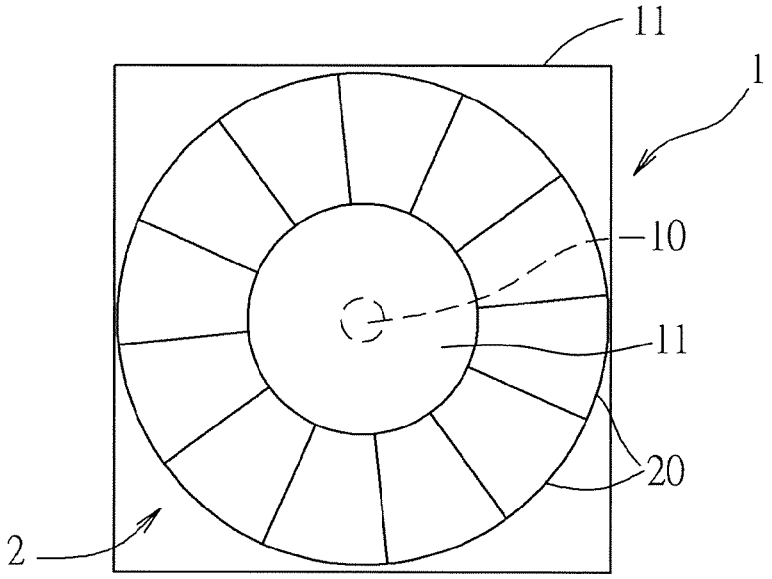
FIG. 3 is a schematic front view of a first embodiment of a fan according to the disclosure, illustrating flaps of a backflow prevention device of the first embodiment being at closed positions.
Figure 4:
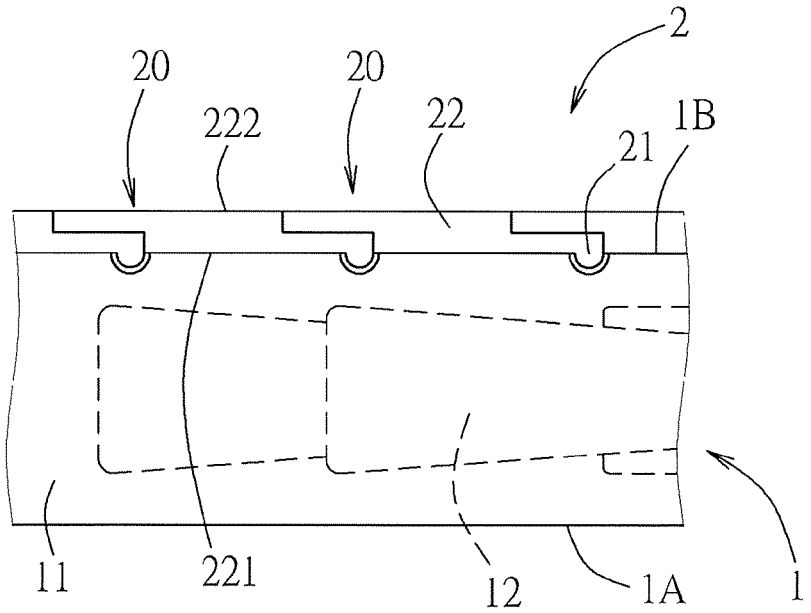
FIG. 4 is a fragmentary schematic side view of the first embodiment, illustrating the flaps being at the closed positions.

Before the present disclosure is described in greater detail, it should be noted that like elements are denoted by the same reference numerals throughout the disclosure.

As shown in FIGS. 3 to 6, a first embodiment of a fan 1 according to the present disclosure is adapted to cooperate with other fans (not shown) for use in a server (not shown). The fan 1 includes a casing 11, a blade unit 12 and a backflow prevention device 2.

The casing 11 defines an airflow inlet 1A and an airflow outlet 1B. The blade unit 12 is disposed in the casing 11 and is rotatable about a rotating axis 10.

Figure 7:
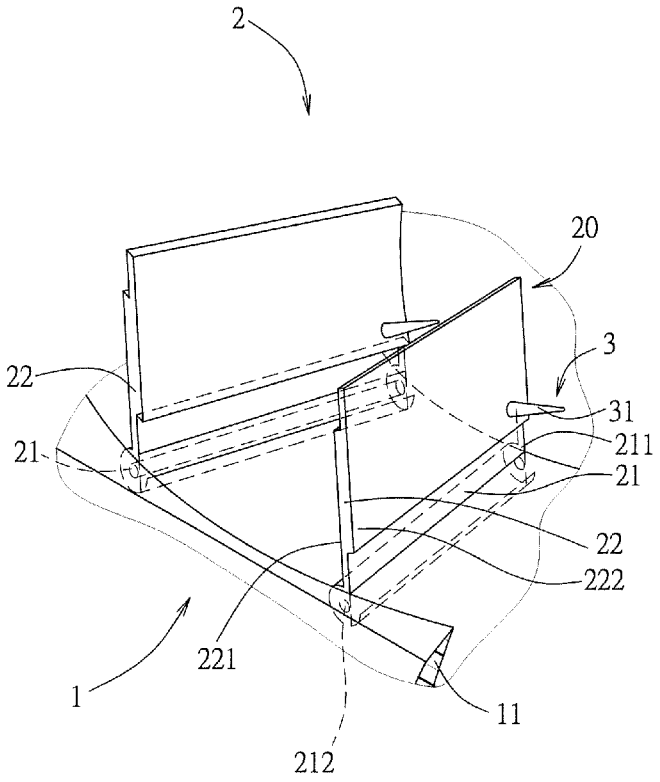
FIG. 7 is a fragmentary perspective view of the first embodiment, illustrating a structure of the backflow prevention device.

The backflow prevention device 2 includes a plurality of flaps 20 and a limiting mechanism 3 (see FIG. 7). The flaps 20 are angularly arranged about the rotating axis 10, and are disposed adjacent to the airflow outlet 1B.

Figure 17:
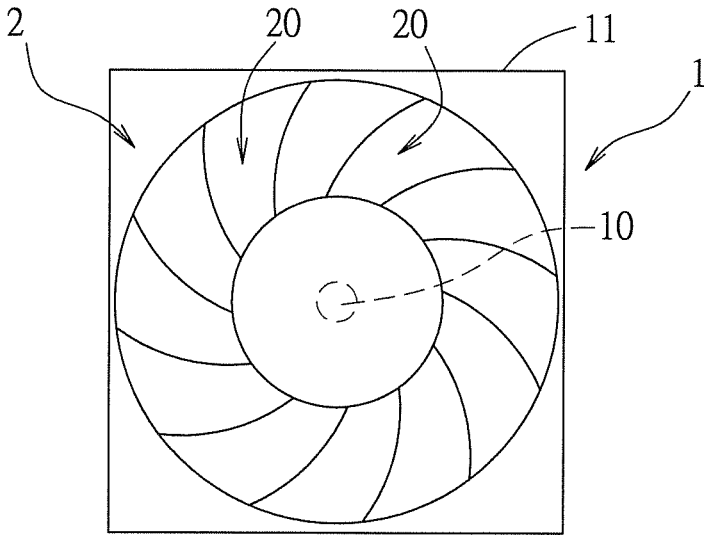
FIGS. 17 and 18 are schematic front views of the first embodiment, illustrating a variation of the flaps of the backflow prevention device.
Figure 18:
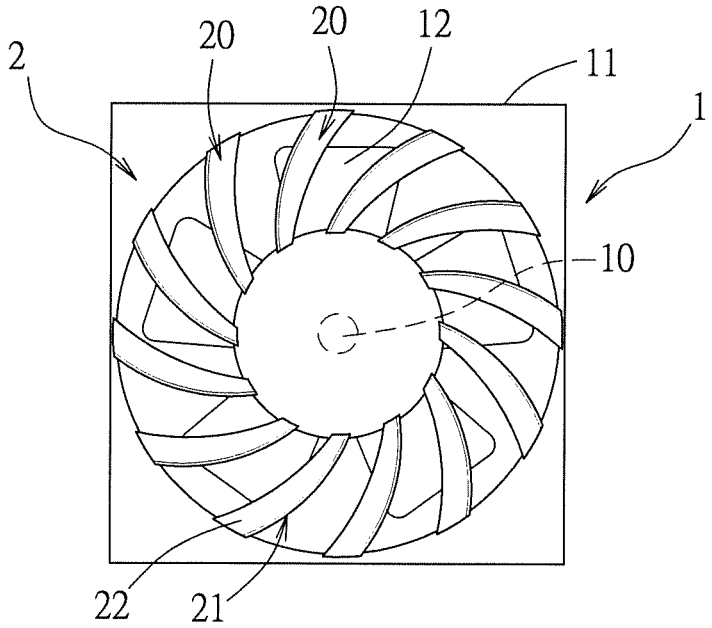

Referring further to FIG. 7, each of the flaps 20 has a pin segment 21 and a wing segment 22. Each pin segment 21 is connected pivotally to an outer surface of the casing 11, extends in a radial direction of the blade unit 12, and has opposite first and second pin ends 211, 212, wherein the first pin end 211 is proximate to the rotating axis 10 of the blade unit 12, and the second pin end 212 is distal from the rotating axis 10. Each wing segment 22 extends from a portion of the corresponding pin segment 21 between the first and second pin ends 211, 212, and has two opposite ends defined respectively by first and second side surfaces 221, 222. In this embodiment, each wing segment 22 is made of plastic and is lightweight. But each wing segment 22 may be made of metal, as long as it is easily driven to move by airflow. Moreover, as shown in FIGS. 17 and 18, each of the flaps 20 may extend spirally instead of extending in the radial direction of the blade unit 12.

Figure 5:
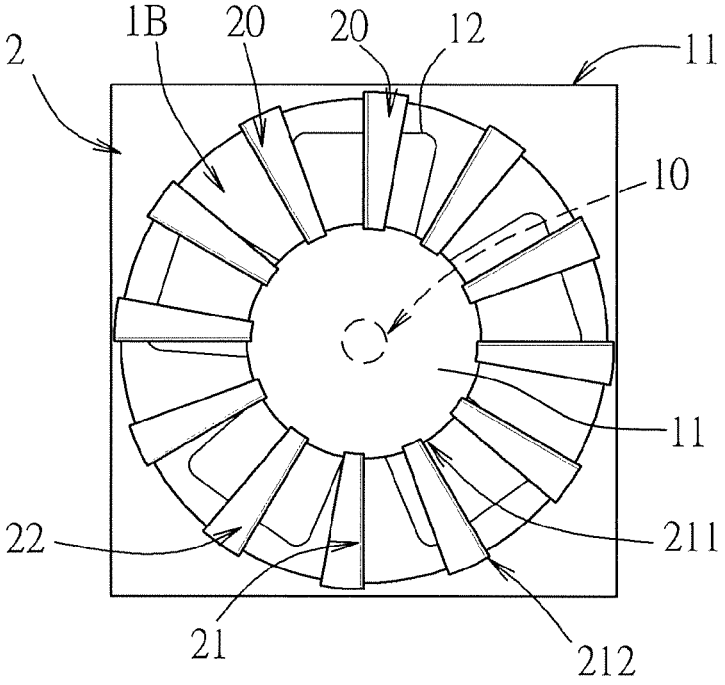
FIG. 5 is another schematic front view of the first embodiment, illustrating the flaps being at open positions.
Figure 6:
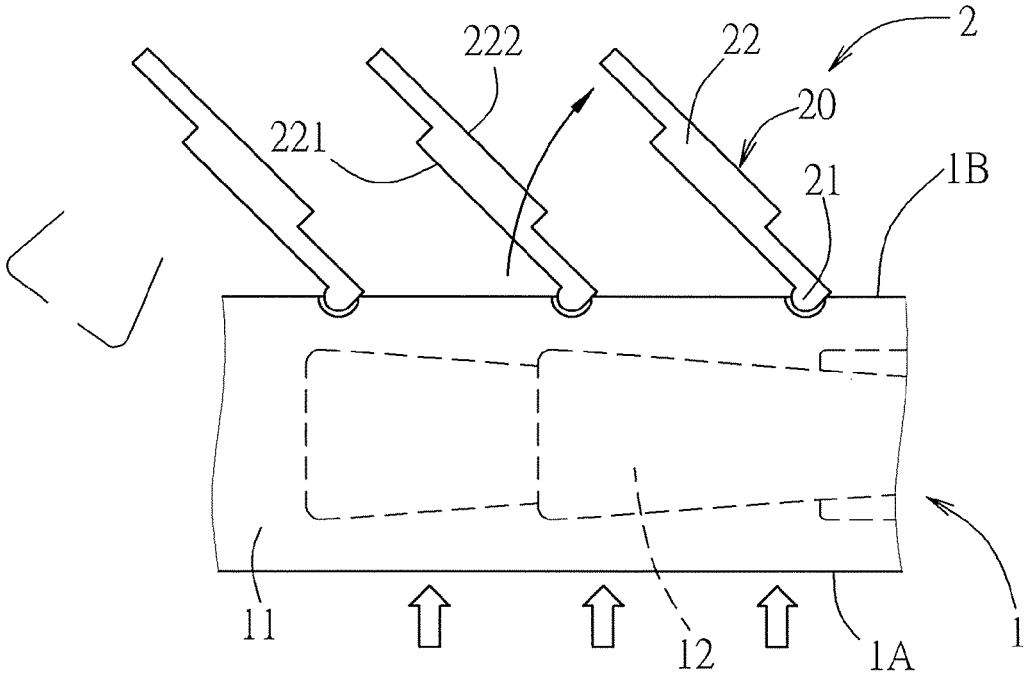
FIG. 6 is another fragmentary schematic side view of the first embodiment, illustrating the flaps being at the open positions.

Referring to FIGS. 5 to 7, when the blade unit 12 is driven to rotate to generate an airflow that enters the casing 11 via the airflow inlet 1A and exits the casing 11 via the airflow outlet 1B, the flaps 20 are driven by the airflow to pivot away from the blade unit 12. It is noted that the directions of the drawings are not comprehended as those of the actual use of the fan of this disclosure. Generally, the casing 11 is disposed in an upright direction on the server, and the airflow moves in a horizontal direction.

Figure 8:
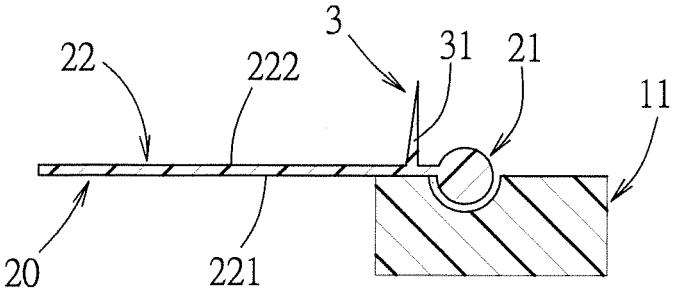
FIGS. 8 to 10 are schematic fragmentary sectional views, illustrating a limiting mechanism of the backflow prevention device of the first embodiment.
Figure 9:
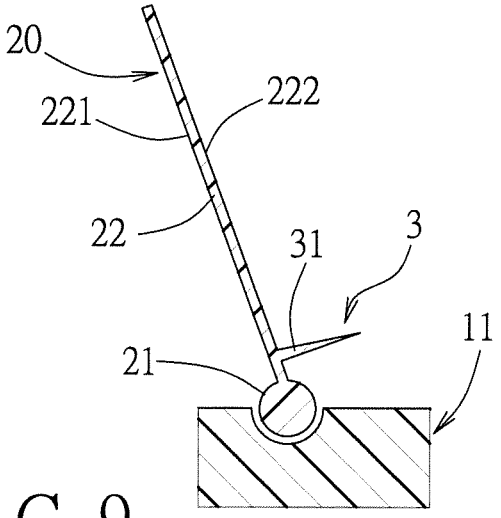
Figure 10:
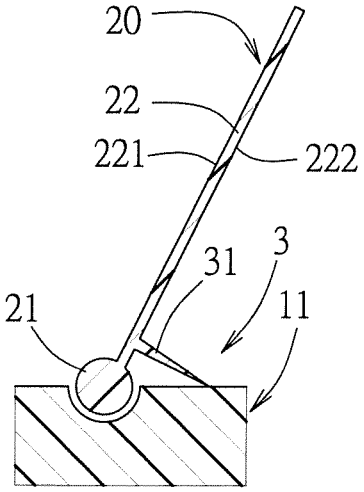

Referring further to FIGS. 8 to 10, the flaps 20 are driven by the airflow to pivot to open positions, where each of the flaps 20 forms an angle relative to the outer surface of the casing 11. The limiting mechanism 3 of the first embodiment includes a plurality of limiting columns 31. Each of the limiting columns 31 is disposed on the second side surface 222 of the wing segment 22 of a respective one of the flaps 20, and abuts against the casing 11 when the respective one of the flaps 20 is at the open position. At this time, the flaps 20 serve as stator blades for the fan 1 to concentrate and intensify the airflow generated by the blade unit 12. The number, the configuration and the open angle of the flaps 20 can be further determined to obtain a superior performance of the flaps 20 when the flaps 20 serve as stator blades. In this embodiment, each of the limiting columns 31 is disposed adjacent to the first pin end 211 of the respective one of the flaps 20. However, the limiting columns 31 may have other configurations as long as they abut against the casing 11 when the flaps are at the open positions.

Once a failure of the fan 1 occurs and rotation of the blade unit 12 is stopped, the flaps 20 are driven by a reverse flow (i.e., backflow) that results from a pressure difference between opposite sides of the backflow prevent ion device 2 and that is directed toward the airflow outlet 1B and the blade unit 12 to pivot toward the blade unit 12 to closed positions, where the flaps 20 close the airflow outlet 1B to prevent air from entering the casing 11 via the airflow outlet 1B (i.e., to prevent further backflows). When the flaps 20 are at the closed positions, the first side surfaces 221 of the flaps 20 face toward the casing 11, and any two adjacent ones of the flaps 20 are overlapped. However, any two adjacent ones of the flaps 20 may just contact intimately each other to close the airflow outlet 1B. It is noted that a rotational angle of each of the flaps 20 relative to the casing 11 from the closed position to the open position is limited by the limiting mechanism 3.

Figure 11:
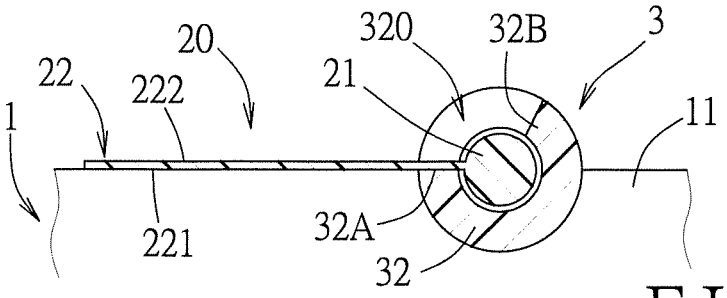
FIGS. 11 to 13 are schematic fragmentary sectional views, illustrating a limiting mechanism of a backflow prevention device of a second embodiment of a fan according to the disclosure.
Figure 12:
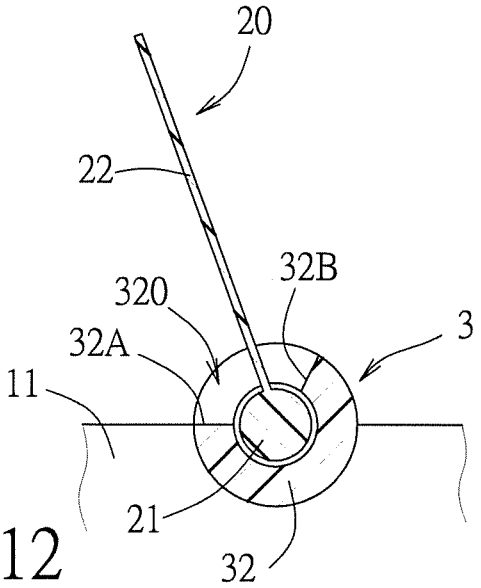
Figure 13:
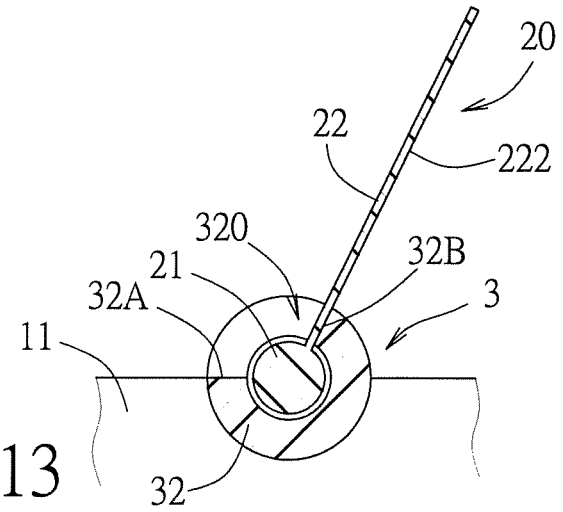

Referring to FIGS. 11 to 13, the limiting mechanism 3 of the backflow prevention device 2 of a second embodiment of the fan 1 according to the present disclosure has a configuration different from that of the first embodiment.

The limiting mechanism 3 of the second embodiment includes a plurality of ring pieces 32 that are connected fixedly to the casing 11. Each of the ring pieces 32 is formed with a fan-shaped groove 320 that extends in a circumferential direction of the ring pieces 32 and that has two opposite ends defined respectively by first and second groove end surfaces 32A, 32B. Each of the flaps 20 engages a respective one of the ring pieces 32 with the pin segment 21 being inserted rotatably into the respective one of the ring pieces 32 and with a portion of the wing segment 22 being retained in the fan-shaped groove 320 of the respective one of the ring pieces 32. The first side surface 221 of the wing segment 22 of each of the flaps 20 abuts against the first groove end surface 32A of the respective one of the ring pieces 32 when the corresponding flap 20 is at the closed position. The second side surface 222 of the wing segment 22 of each of the flaps 20 abuts against the second groove end surface 32B of the respective one of the ring pieces 32 when the corresponding flap 20 is at the open position to limit the angle between the corresponding flap 20 and the outer surface of the casing 11.

Figure 14:
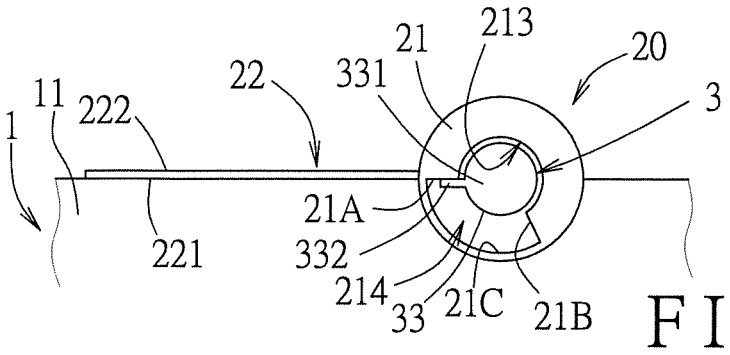
FIGS. 14 to 16 are schematic fragmentary sectional views, illustrating a limiting mechanism of a backflow prevention device of a third embodiment of a fan according to the disclosure.
Figure 15:
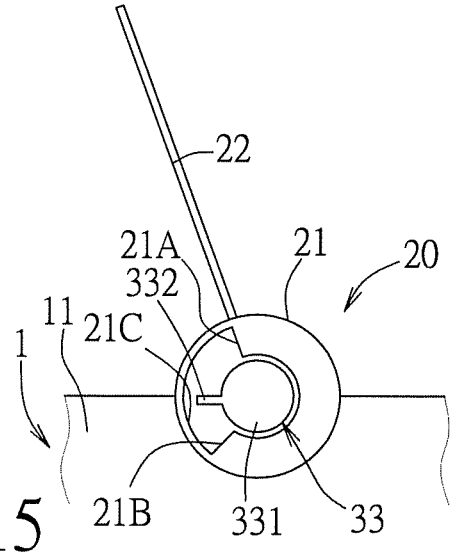
Figure 16:
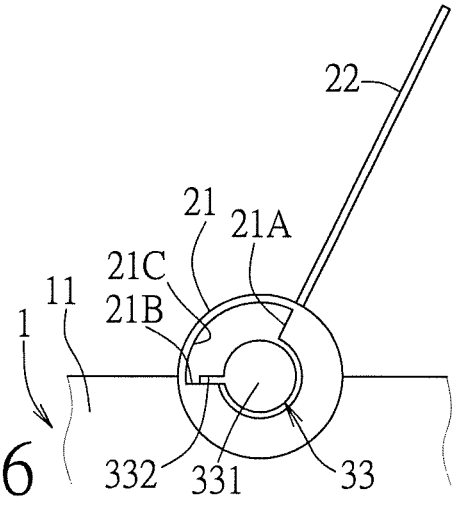

Referring to FIGS. 14 to 16, the limiting mechanism 3 of the backflow prevention device 2 of a third embodiment of the fan 1 according to the present disclosure has a configuration different from that of the first embodiment.

The limiting mechanism 3 of the third embodiment includes a plurality limiting rods 33 that are connected fixedly to the casing 11. The pin segment 21 of each of the flaps 20 is formed with a rod-retaining hole 213 that extends in an axial direction of the pin segment 21, and a fan-shaped limiting space 214 that extends in a circumferential direction of the pin segment 21, that is defined by a space curved side surface 21C and opposite first and second space end surfaces 21A, 21B permitting the space curved side surface 21C to be connected therebetween, and that communicates spatially with the rod-retaining hole 213. Each of the limiting rods 33 has a rod body 331 and a limiting block 332. The rod body 331 extends rotatably into the rod-retaining hole 213 of the ping segment 21 of a respective one of the flaps 20. The limiting block 332 protrudes from an outer peripheral surface of the rod body 331, and is retained in the fan-shaped limiting space 214 of the ping segment 21 of the respective one of the flaps 20. The limiting block 332 of each of the limiting rods 33 abuts against the first space end surface 21A of the ping segment 21 of the respective one of the flaps 20 when the respective one of the flaps 20 is at the closed position. The limiting block 332 of each of the limiting rods 33 abuts against the second space end surface 21B of the ping segment 21 of the respective one of the flaps 20 when the respective one of the flaps 20 is at the open position to limit the angle between the flap 20 and the outer surface of the casing 11.

To sum up, the backflow prevention device 2 of the fan 1 of this disclosure serves as stator blades to intensify the airflow generated by the blade unit 12 when the blade unit 12 works regularly. The backflow prevention device 2 closes the airflow outlet 1B to prevent air from entering the casing 11 via the airflow outlet 1B when the blade unit 12 is stopped. Moreover the fan 1 does not has additional structure to interfere the intensified airflow, and therefore has a smaller thickness as compared with the conventional fan illustrated in the prior art.

While the present disclosure has been described in connection with what are considered the most practical and embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A backflow prevention device adapted for use in a fan, the fan including a casing that defines an airflow inlet and an airflow outlet, and a blade unit that is disposed rotatably in the casing, said backflow prevention device comprising:

a plurality of angularly-arranged flaps adapted to be disposed adjacent to the airflow outlet, each of said flaps having a pin segment that is adapted to be connected pivotally to the casing, wherein the pin segment has a first pin end adapted to be connected pivotally to an inner surface of the casing and the inner surface adapted to be proximate to a rotating axis of the blade unit, and a second pin end opposite to said first pin end adapted to be connected pivotally to an outer surface of the casing, and a wing segment that extends from a portion of said pin segment between said first and second pin ends;

a limiting mechanism, disposed at or substantially closed to the first pin end, adapted to limit a rotational angle of each of said flaps relative to the casing, wherein, when the blade unit is driven to rotate to generate an airflow that enters the casing via the airflow inlet and exits the casing via the airflow outlet, said flaps are driven by the airflow to pivot away from the blade unit to open positions, where each of said flaps forms an angle relative to the outer surface of the casing, and said flaps are adapted to serve as stator blades for the fan;

wherein, when rotation of the blade unit is stopped, said flaps are driven by a reverse flow directed toward the airflow outlet and the blade unit to pivot toward the blade unit to closed positions, where said flaps close the airflow outlet to prevent air from entering the casing via the airflow outlet; and wherein said wing segment of each of said flaps has opposite first and second side surfaces, said first side surface of each of said flaps facing toward the casing when a corresponding one of said flaps is at the closed position, said limiting mechanism including a plurality of limiting columns, each of said limiting columns being disposed on said second side surface of said wing segment of a respective one of said flaps, and abutting against the casing when the respective one of said flaps is at the open position.

2. A backflow prevention device adapted for use in a fan, the fan including a casing that defines an airflow inlet and an airflow outlet, and a blade unit that is disposed rotatably in the casing, said backflow prevention device comprising:

a plurality of angularly-arranged flaps adapted to be disposed adjacent to the airflow outlet, each of said flaps having a pin segment that is adapted to be connected pivotally to the casing, wherein the pin segment has a first pin end adapted to be connected pivotally to an inner surface of the casing and the inner surface adapted to be proximate to a rotating axis of the blade unit, and a second pin end opposite to said first pin end adapted to be connected pivotally to an outer surface of the casing, and a wing segment that extends from a portion of said pin segment between said first and second pin ends;

a limiting mechanism, disposed at or substantially closed to the first pin end, adapted to limit a rotational angle of each of said flaps relative to the casing, wherein, when the blade unit is driven to rotate to generate an airflow that enters the casing via the airflow inlet and exits the casing via the airflow outlet, said flaps are driven by the airflow to pivot away from the blade unit to open positions, where each of said flaps forms an angle relative to the outer surface of the casing, and said flaps are adapted to serve as stator blades for the fan;

wherein, when rotation of the blade unit is stopped, said flaps are driven by a reverse flow directed toward the airflow outlet and the blade unit to pivot toward the blade unit to closed positions, where said flaps close the airflow outlet to prevent air from entering the casing via the airflow outlet; and wherein said limiting mechanism includes a plurality of ring pieces that are connected fixedly to the casing, each of said ring pieces being formed with a fan-shaped groove that extends in a circumferential direction thereof and that has two opposite ends defined respectively first and second groove end surfaces, each of said flaps engaging a respective one of said ring pieces with said pin segment being inserted rotatably into the respective one of said ring pieces and with a portion of said wing segment being retained in said fan-shaped groove of the respective one of said ring pieces, said wing segment of each of said flaps having opposite first and second side surfaces, said first side surface of said wing segment of each of said flaps facing toward the casing and abutting against said first groove end surface of the respective one of said ring pieces when a corresponding one of said flaps is at the closed position, said second side surface of said wing segment of each of said flaps abutting against said second groove end surface of the respective one of said ring pieces when the corresponding one of said flaps is at the open position.

3. A backflow prevention device adapted for use in a fan, the fan including a casing that defines an airflow inlet and an airflow outlet, and a blade unit that is disposed rotatably in the casing, said backflow prevention device comprising:

a plurality of angularly-arranged flaps adapted to be disposed adjacent to the airflow outlet, each of said flaps having a pin segment that is adapted to be connected pivotally to the casing, wherein the pin segment has a first pin end adapted to be connected pivotally to an inner surface of the casing and the inner surface adapted to be proximate to a rotating axis of the blade unit, and a second pin end opposite to said first pin end adapted to be connected pivotally to an outer surface of the casing, and a wing segment that extends from a portion of said pin segment between said first and second pin ends;

a limiting mechanism, disposed at or substantially closed to the first pin end, adapted to limit a rotational angle of each of said flaps relative to the casing, wherein, when the blade unit is driven to rotate to generate an airflow that enters the casing via the airflow inlet and exits the casing via the airflow outlet, said flaps are driven by the airflow to pivot away from the blade unit to open positions, where each of said flaps forms an angle relative to the outer surface of the casing, and said flaps are adapted to serve as stator blades for the fan;

wherein, when rotation of the blade unit is stopped, said flaps are driven by a reverse flow directed toward the airflow outlet and the blade unit to pivot toward the blade unit to closed positions, where said flaps close the airflow outlet to prevent air from entering the casing via the airflow outlet; and wherein said limiting mechanism includes a plurality limiting rods that are connected fixedly to the casing, said pin segment of each of said flaps being formed with a rod-retaining hole that extends in an axial direction of said pin segment, and a fan-shaped limiting space that extends in a circumferential direction of said pin segment, that has two opposite ends defined respectively by first and second space end surfaces, and that communicates spatially with said rod-retaining hole, each of said limiting rods having a rod body that extends rotatably into said rod-retaining hole of said ping segment of a respective one of said flaps, and a limiting block that protrudes from an outer peripheral surface of said rod body, and that is retained in said fan-shaped limiting space of said ping segment of the respective one of said flaps, said limiting block of each of said limiting rods abutting against said first space end surface of said ping segment of the respective one of said flaps when the respective one of said flaps is at the closed position, said limiting block of each of said limiting rods abutting against said second space end surface of said ping segment of the respective one of said flaps when the respective one of said flaps is at the open position.

* * * * *